US009061292B2

(12) United States Patent
Yamasaki et al.

(10) Patent No.: US 9,061,292 B2
(45) Date of Patent: Jun. 23, 2015

(54) ELECTROSTATIC COATING GUN

(75) Inventors: Isamu Yamasaki, Toyota (JP); Fumihiro Takase, Toyota (JP); Kimiyoshi Nagai, Yokohama (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 116 days.

(21) Appl. No.: 13/825,906

(22) PCT Filed: Sep. 27, 2011

(86) PCT No.: PCT/IB2011/002247

§ 371 (c)(1), (2), (4) Date: Mar. 25, 2013

(87) PCT Pub. No.: WO2012/042344

PCT Pub. Date: Apr. 5, 2012

(65) Prior Publication Data

US 2013/0181074 A1 Jul. 18, 2013

(30) Foreign Application Priority Data

Sep. 27, 2010 (JP) ..... 2010-216121

(51) Int. Cl.
*B05B 5/00* (2006.01)
*F23D 11/32* (2006.01)
(Continued)

(52) U.S. Cl.
CPC ..... *B05B 5/0407* (2013.01); *B05B 5/0531* (2013.01); *B05B 5/1608* (2013.01); *B05B 12/1409* (2013.01); *B05B 13/0452* (2013.01)

(58) Field of Classification Search
CPC ..... B05B 5/00; B05B 5/002; B05B 5/007; B05B 5/0255; B05B 5/04; B05B 5/0433; B05B 5/0407; B05B 5/0415
USPC ..... 239/690–700, 703–704, 706, 708; 118/620–643
See application file for complete search history.

(56) References Cited

U.S. PATENT DOCUMENTS 3,009,441 A * 11/1961 Juvinall ..... 118/624
4,182,490 A * 1/1980 Kennon ..... 239/3
(Continued)

FOREIGN PATENT DOCUMENTS

CN 101090773 A 12/2007
JP 6 320070 11/1994
(Continued)

OTHER PUBLICATIONS

International Search Report Issued Mar. 2, 2012 in PCT/IB11/02247 Filed Sep. 27, 2011.

*Primary Examiner* — Len Tran
*Assistant Examiner* — Tuongminh Pham
(74) *Attorney, Agent, or Firm* — Oblon, McClelland, Maier & Neustadt, L.L.P.

(57) ABSTRACT

A coating gun includes: a high-voltage generating device that is used to generate high voltage; an air motor that is a motor portion to which the high voltage is applied; a bell cup that is supported on a rotary shaft of the air motor and to which the high voltage is applied; a CCV unit that selectively supplies a plurality of types of coatings to the bell cup; a gun body that is a casing and that contains the high-voltage generating device, the air motor and the CCV unit; and a coupling portion that is used to couple the gun body to a robot arm and that is grounded. The air motor and the CCV unit are electrically connected to each other via a first resistor, and the coupling portion and the CCV unit are electrically connected to each other via a second resistor.

3 Claims, 5 Drawing Sheets

(51) Int. Cl.

| | |
|---|---|
| ***B05B 5/04*** | (2006.01) |
| ***B05B 5/16*** | (2006.01) |
| *B05B 5/053* | (2006.01) |
| *B05B 12/14* | (2006.01) |
| *B05B 13/04* | (2006.01) |

(56) References Cited

U.S. PATENT DOCUMENTS

| | | | | |
|---|---|---|---|---|
| 5,697,559 | A * | 12/1997 | Davis et al. | 239/703 |
| 6,010,084 | A * | 1/2000 | Yoshida et al. | 239/703 |
| 6,042,030 | A * | 3/2000 | Howe et al. | 239/703 |
| 6,230,994 | B1 | 5/2001 | Boerner et al. | |
| RE38,526 | E * | 6/2004 | Hansinger et al. | 239/3 |
| 2009/0020635 | A1 * | 1/2009 | Yasuda | 239/703 |
| 2013/0181074 | A1 | 7/2013 | Yamasaki et al. | |

FOREIGN PATENT DOCUMENTS

| | | | |
|---|---|---|---|
| JP | 07-031903 | A | 2/1995 |
| JP | 07-171445 | A | 7/1995 |
| JP | 10 5634 | | 1/1998 |
| JP | 10-080650 | A | 3/1998 |
| JP | 11 128784 | | 5/1999 |
| JP | 11 267553 | | 10/1999 |
| JP | 2000-117155 | A | 4/2000 |
| JP | 2007 50336 | | 3/2007 |
| JP | 2010-104935 | A | 5/2010 |
| JP | 2012-050949 | A | 3/2012 |
| WO | 2006 067983 | | 6/2006 |
| WO | 2012/028942 | A2 | 3/2012 |
| WO | 2012/042344 | A1 | 4/2012 |

* cited by examiner

ELECTROSTATIC COATING GUN

BACKGROUND OF THE INVENTION

1. Field of the Invention

The invention relates to a technique for an electrostatic coating gun that is able to selectively use a plurality of types of coatings.

2. Description of Related Art

In an existing art, in order for an electrostatic coating gun to be able to perform coating while changing a plurality of types of coatings in a short period of time, there is known a multicolor coating gun that includes a color change valve (hereinafter, abbreviated as CCV) for changing among a plurality of coatings. In addition, in recent years, when a multicolor coating gun is used, in order to reduce a time required for color change, a multicolor coating gun in which a color change valve unit (hereinafter, referred to as CCV unit) having a plurality of CCVs is arranged inside a casing that contains an air motor, or the like, of the coating gun has been employed, and the technique for such a multicolor coating gun is described in Japanese Patent Application Publication No. 2007-50336 (JP-A-2007-50336) and is publicly known.

In the coating gun according to the related art described in JP-A-2007-50336, the CCV unit is arranged immediately behind the air motor inside the casing that contains the air motor to minimize a path for supplying a coating from the CCV unit to a bell cup. With the above configuration, it is possible to minimize the amount of coating remaining in the path for supplying a coating from the CCV unit to the bell cup, so it is possible to reduce a time required for color change and reduce wasted coatings.

Usually, high voltage is applied by a high-voltage generating device to the air motor, the bell cup, and the like. The air motor is contained in the casing of the electrostatic coating gun. The bell cup is supported by the air motor. In addition, a robot arm that displaceably supports the coating gun is generally connected to a ground, and the potential of the robot arm is kept at "0". Therefore, in the existing electrostatic coating gun, there is a difference in potential between a portion, such as the air motor, to which high voltage is applied (hereinafter, referred to as high-voltage region) and a grounded portion of the coating gun (hereinafter, referred to as a grounded region), so the air motor (high-voltage region) needs to ensure a sufficient distance that does not cause a dielectric breakdown (that is, insulation distance) from the grounded region. Note that the "insulation distance" here is a concept including a creepage distance and a spatial distance.

In the coating gun described in JP-A-2007-50336, the same high voltage as that applied to the air motor is also applied to the CCV unit, and the CCV unit also belongs to the high-voltage region, so it is necessary to ensure the insulation distance between the CCV unit and the grounded region. Then, in such a case, in order to ensure the insulation distance between the CCV unit and the grounded region, it is necessary to take measures, such as increasing the size of the casing. When the CCV unit is contained in the casing of the coating gun, it is difficult to construct a compact electrostatic coating gun.

SUMMARY OF THE INVENTION

The invention provides an electrostatic coating gun that is able to achieve a compact configuration while arranging a CCV unit and an air motor in the same casing.

An aspect of the invention provides an electrostatic coating gun. The electrostatic coating gun includes: a high-voltage generating device that is used to generate high voltage; a motor portion to which the high voltage is applied; a bell cup that is supported on a rotary shaft of the motor portion and to which the high voltage is applied; a CCV unit that selectively supplies a plurality of types of coatings to the bell cup; a casing that contains the high-voltage generating device, the motor portion and the CCV unit; and a coupling portion that is used to couple the casing to a robot arm and that is grounded, wherein the motor portion and the CCV unit are electrically connected to each other via a first resistor, and the coupling portion and the CCV unit are electrically connected to each other via a second resistor.

According to the above aspect, an insulation distance that should be ensured around the CCV unit may be reduced. By so doing, the coating gun that contains the CCV unit may be further compact.

In the above aspect, the first resistor and the second resistor each may be formed of a variable resistor of which a resistance value is variable.

According to the above aspect, even when the types of coatings used and the number of the types are changed, a voltage applied to the CCV unit may be adjusted to a constant value. By so doing, a voltage applied to the CCV unit may be reliably adjusted to an applied voltage appropriate to the insulation distance that may be ensured around the CCV unit in the gun body.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
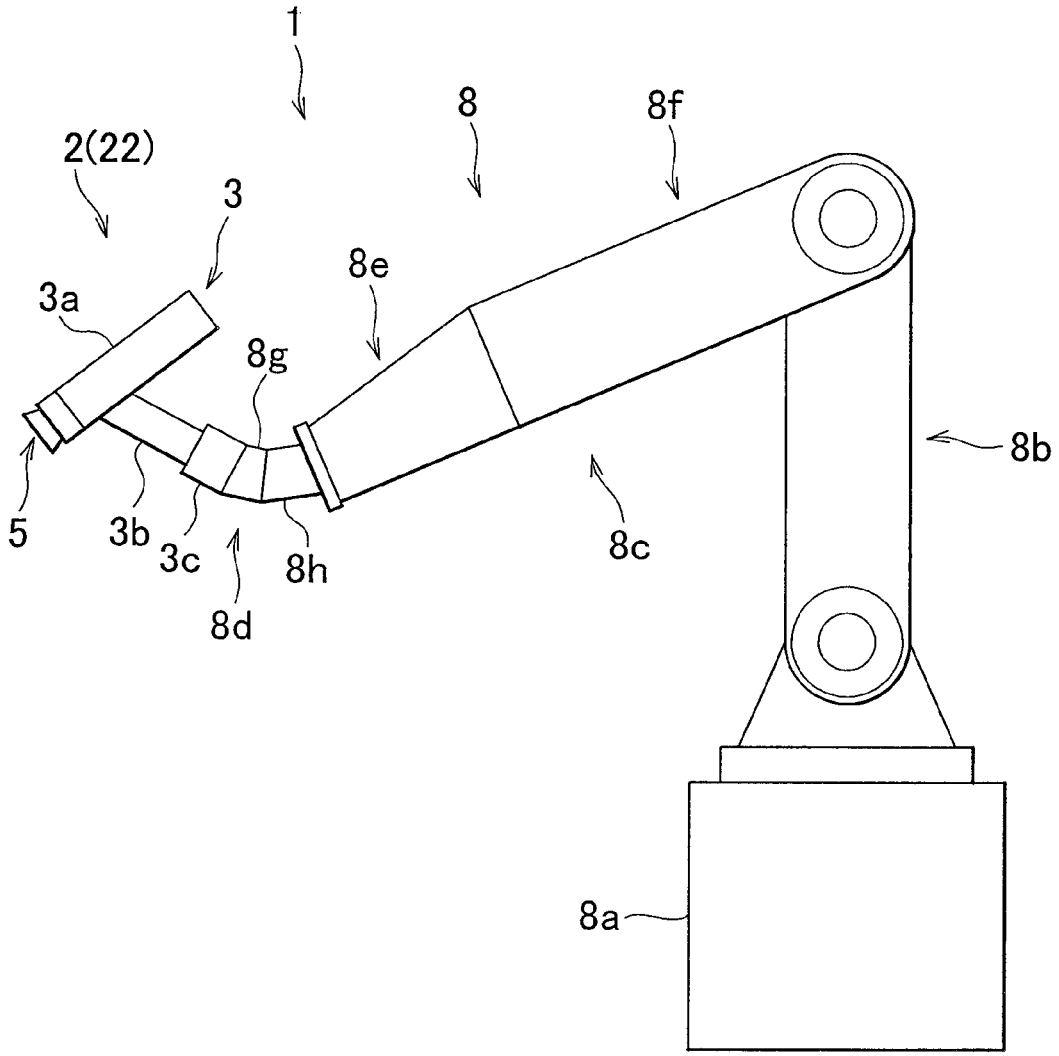
FIG. 1 is a schematic view that shows the overall configuration of an electrostatic coating apparatus that includes a coating gun according to a first embodiment of the invention.
Figure 2:
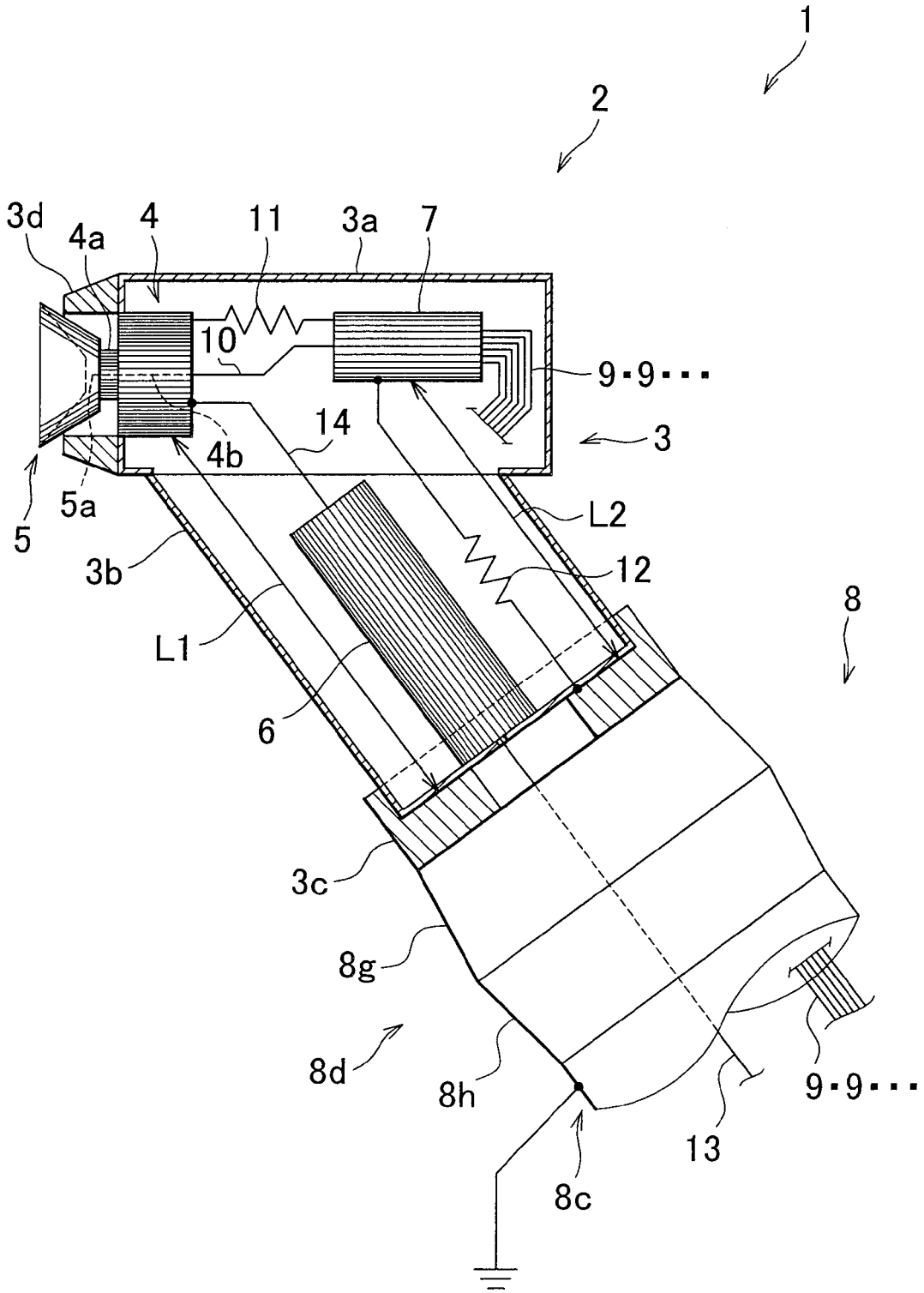
FIG. 2 is a schematic cross-sectional view of the coating gun according to the first embodiment of the invention.

Next, a first embodiment of the invention will be described. First, the overall configuration of an electrostatic coating apparatus that includes a coating gun according to a first embodiment of the invention will be described with reference to FIG. 1 to FIG. 3B. As shown in FIG. 1 and FIG. 2, the electrostatic coating apparatus 1 is able to electrostatically coat a coated object. The coated object is an object on which a coating is performed. The electrostatic coating apparatus 1 includes the coating gun 2, a robot arm 8, and the like. The coating gun 2 is an electrostatic coating gun according to the first embodiment of the invention.

The coating gun 2 is used to spray an atomized electrically-charged coating onto the coated object, and includes a gun body 3, an air motor 4, a bell cup 5, a high-voltage generating device 6, a CCV unit 7, and the like. The coating gun 2 is a rotary atomizing coating device that is able to spread a liquid coating supplied onto the inner surface of the bell cup 5 by the CCV unit 7 and atomize the spread liquid coating with centrifugal force by rotating the bell cup 5 using the air motor 4.

The gun body 3 constitutes the casing of the coating gun 2. The gun body 3 is formed of a first casing portion 3*a*, a second casing portion 3*b*, a coupling portion 3*c*, a shaping air ring 3*d*, and the like. The first casing portion 3*a* is used to contain portions (that is, the air motor 4, the CCV unit 7, and the like) required to supply and atomize a coating to be sprayed by the coating gun 2.

In addition, the second casing portion 3*b* extends from the first casing portion 3*a* so as to be inclined at a predetermined angle with respect to the first casing portion 3*a* in order to support the first casing portion 3*a* at the predetermined angle suitable for spraying a coating. The second casing portion 3*b* contains the high-voltage generating device 6, and the like. Then, the coupling portion 3*c* that is a portion for coupling the coating gun 2 to the robot arm 8 is formed at an end portion of the second casing portion 3*b*.

In addition, the shaping air ring 3*d* is attached to the front portion of the first casing portion 3*a* in a direction in which a coating is sprayed. The shaping air ring 3*d* is used to inject shaping air from the rear portion of the bell cup 5 in a predetermined pattern in order to apply propelling force to a coating atomized by the bell cup 5 arranged at the front portion thereof and diffuse the coating in a predetermined pattern. An air line (not shown) is connected to the shaping air ring 3*d*.

The air motor 4 is used to rotate the bell cup 5, and is contained in the first casing portion 3*a*. In addition, the air motor 4 includes a rotary shaft 4*a* that is a shaft portion that rotates with air supplied. The air motor 4 protrudes the rotary shaft 4*a* from the first casing portion 3*a* toward the direction in which a coating is sprayed. Then, the bell cup 5 is supported on the rotary shaft 4*a*.

The bell cup 5 is used to atomize a coating. The bell cup 5 is rotatably supported on the rotary shaft 4*a* so that the axis of the rotary shaft 4*a* coincides with the axis of the bell cup 5. In addition, a coating supply hole 4*b* is formed along the axis of the rotary shaft 4*a* of the air motor 4. The coating supply hole 4*b* extends through in the axial direction, and allows a coating to flow therethrough. Furthermore, a coating supply hole 5*a* is formed along the axis of the bell cup 5. The coating supply hole 5*a* extends through in the axial direction, and is used to supply a coating onto the inner surface of the bell cup 5.

In addition, the high-voltage generating device 6 is contained in the second casing portion 3*b* of the gun body 3. The high-voltage generating device 6 is used to generate high voltage applied to a coating to be sprayed by the coating gun 2.

Then, a power supply portion (not shown) is connected to the high-voltage generating device 6 via a low-voltage cable 13, and a predetermined voltage is supplied from the power supply portion to the high-voltage generating device 6. Then, the high-voltage generating device 6 is used to step up the supplied voltage to a predetermined high voltage and then apply the high voltage to the air motor 4 via a high-voltage cable 14.

Then, the coating gun 2 is able to apply high voltage to the air motor 4 and electrically charge particles of a coating diffused from the bell cup 5 by cause electrostatic high voltage to be applied to the bell cup 5 via the air motor 4. Then, an electrostatic field formed between the electrically charged coating and the grounded (that is, the potential is 0 V) coated object is utilized to perform electrostatic coating.

In addition, the CCV unit 7 is contained in the first casing portion 3*a* of the gun body 3. The CCV unit 7 includes a plurality of CCVs (not shown). The CCV unit 7 is able to selectively supply a plurality of types of coatings to the bell cup 5. Primary coating supply lines 9 that are multiple circuit coating lines for supplying a plurality of types of coatings are connected to the CCV unit 7. In addition, the primary coating supply lines 9 are respectively connected to a plurality of coating tanks (not shown) in which coatings of respective types are stored.

In addition, a secondary coating supply line 10 that is a single circuit coating line for supplying a coating to the bell cup 5 is connected to the CCV unit 7, and the secondary coating supply line 10 is connected to the coating supply hole 4*b* and the coating supply hole 5*a*. By so doing, a coating supplied from the CCV unit 7 is supplied to a spreading portion of the front surface of the bell cup 5 through the secondary coating supply line 10, the coating supply hole 4*b* and the coating supply hole 5*a*.

In addition, in the coating gun 2, the air motor 4 and the CCV unit 7 are electrically connected to each other via a first resistor 11, and the CCV unit 7 and the coupling portion 3*c* are electrically connected to each other via a second resistor 12.

As shown in FIG. 1, the robot arm 8 is formed of a vertical arm 8*b* and a horizontal arm 8*c*. The vertical arm 8*b* is pivotably coupled to a base portion 8*a* at its lower portion. The horizontal arm 8*c* is pivotably coupled to the upper portion of the vertical arm 8*b* at its rear end portion. The coating gun 2 is provided at the distal end portion of the horizontal arm 8*c*. The vertical arm 8*b* and the horizontal arm 8*c* are pivoted on their pivot axes to thereby make it possible to displace the coating gun 2 with respect to the coated object.

In addition, the horizontal arm 8*c* is formed of a first arm portion 8*d*, a second arm portion 8*e* and a third arm portion 8*f*. The coupling portion 3*c* of the gun body 3 is coupled to the distal end portion of the first arm portion 8*d*. The first arm portion 8*d* is coupled to the distal end portion of the second arm portion 8*e*. The second arm portion Se is coupled to the distal end portion of the third arm portion 8*f*. The vertical arm 8*b* is pivotably coupled to the rear end portion of the third arm portion 8*f*.

In addition, the first arm portion 8*d* has two bending portions 8*g* and 8*h*, and the first arm portion 8*d* is bent at the bending portions 8*g* and 8*h*. By so doing, the angle of the coating gun 2 may be changed in the clockwise direction or counterclockwise direction in FIG. 1 and FIG. 2.

In addition, the coupling portion 3*c*, by which the coating gun 2 is connected to the robot arm 8, is driven for rotation about its axis with respect to the first arm portion 8*d*, and the coating gun 2 is able to change its angle about the axis of the coupling portion 3*c*. By so doing, the angle of the coating gun 2 with respect to the coated object may be freely set.

Here, the coupling portion 3*c* is electrically connected to the robot arm 8 (more specifically, the bending portion 8*g*) in a state where the coupling portion 3*c* is connected to the robot arm 8. Then, the robot arm 8 is grounded, so the coupling portion 3*c* is also grounded.

In the coating gun 2 according to the first embodiment of the invention, as described above, the air motor 4 is connected to the high-voltage generating device 6, and the coupling portion 3*c* is grounded. Furthermore, in the coating gun 2, the air motor 4 and the CCV unit 7 are electrically connected to each other via the first resistor 11, and the CCV unit 7 and the coupling portion 3*c* are electrically connected to each other via the second resistor 12.

Therefore, high voltage applied to the air motor 4 by the high-voltage generating device 6 is stepped down by the first resistor 11 in accordance with the ratio of the resistance value of the first resistor 11 and the resistance value of the second resistor 12 and is then applied to the CCV unit 7. Furthermore, the voltage applied to the CCV unit 7 is finally stepped down by the second resistor 12 to a state where the potential is "0". That is, in the coating gun 2, a voltage that is lower than the high voltage applied to the air motor 4 by the high-voltage generating device 6 is applied to the CCV unit 7.

Next, the advantageous effects of the coating gun 2 according to the first embodiment of the invention will be described with reference to FIG. 3A and FIG. 3B. In the existing coating gun, the CCV unit 7 and the air motor 4 are electrically connected to each other without passing through a resistor, so, when high voltage is applied to the air motor 4 from the high-voltage generating device 6, high voltage having the same potential is also applied to the CCV unit 7.

Figure 3A:
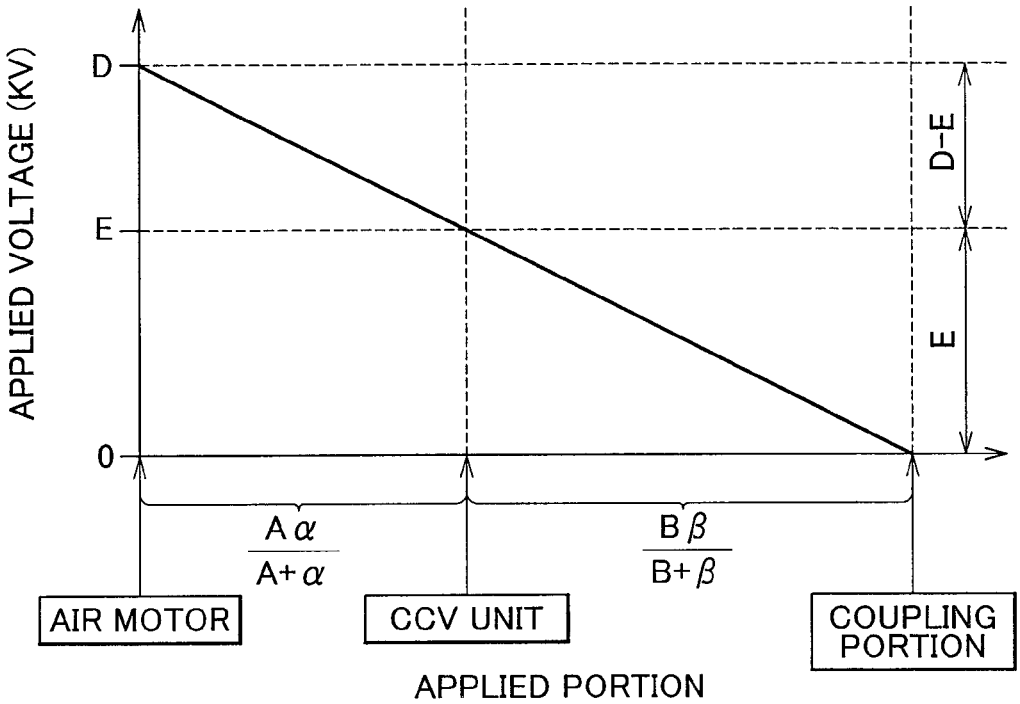
FIG. 3A is a schematic graph that shows a voltage applied to a CCV unit in the case of the coating gun according to the first embodiment of the invention.
Figure 3B:
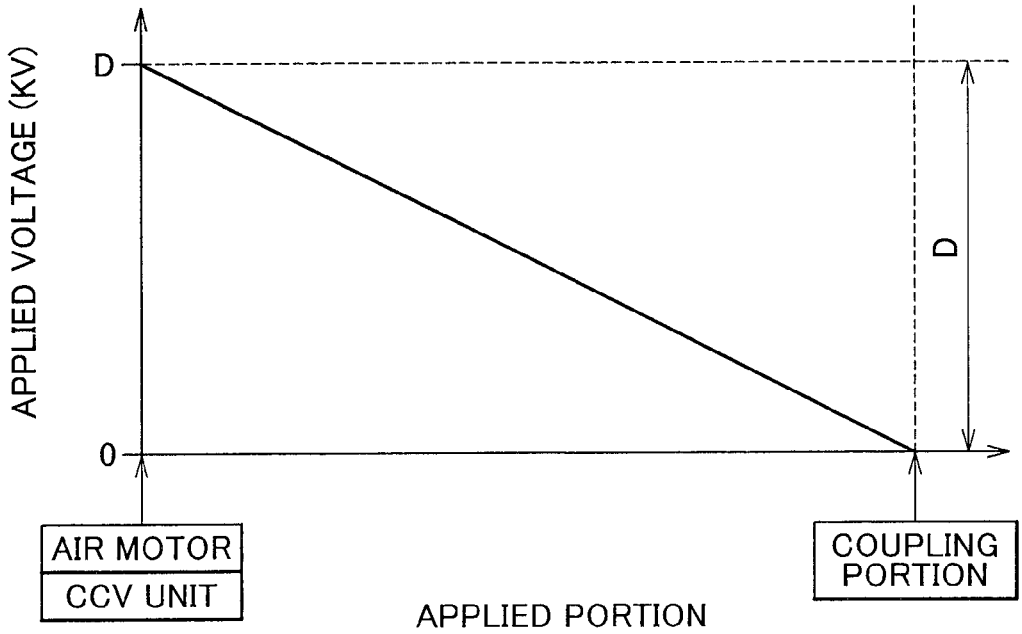
FIG. 3B is a schematic graph that shows a voltage applied to a CCV unit in the case of the existing coating gun.

As shown in FIG. 3B, in the existing coating gun, as high voltage having a voltage D is applied from the high-voltage generating device 6 to the air motor 4, high voltage having the same voltage D as that applied to the air motor 4 is applied to the CCV unit 7, and a potential difference between the CCV unit 7 that is the high-voltage region and the coupling portion 3*c* that is the grounded region is D.

In this case, the air motor 4 and the coupling portion 3*c* need to ensure an insulation distance L1 based on the potential difference D, and the CCV unit 7 and the coupling portion 3*c* need to ensure an insulation distance L2 based on the potential difference D; however, in terms of the possibility of a dielectric breakdown, the CCV unit 7 is closer to the coupling portion 3*c* than the air motor 4, so the minimum required size, or the like, of the gun body 3 is determined on the basis of the insulation distance L2.

Therefore, in the coating gun that does not contain the CCV unit 7, electrostatic safety may be ensured by ensuring the insulation distance L1 of the air Motor 4 on the basis of the potential difference D; however, in the coating gun that contains the CCV unit 7, the insulation distance L2 needs to be ensured on the basis of the potential difference D, so it is more difficult to have a compact coating gun.

In addition, the structure of the first casing portion 3*a* that surrounds the CCV unit 7 also needs to have a structure based on the potential difference D, so, when a portion having a joint, such as an opening, is provided near the CCV unit 7 in the first casing portion 3*a*, it is necessary to particularly consider, for example, ensuring a creepage distance by forming the outer peripheral edge portion of the opening into a complex bent shape.

On the other hand, in the coating gun 2 according to the first embodiment of the invention, the CCV unit 7 and the air motor 4 are electrically connected to each other via the first resistor 11, and the CCV unit 7 and the coupling portion 3*c* are electrically connected to each other via the second resistor 12.

With the above configuration, where the resistance value of the first resistor 11 is A (Ω), the resistance value of the second resistor 12 is B (Ω), the resistance value of a coating that flows through the secondary coating supply line 10 is α (Ω) and the resistance values of coatings that respectively flow through the primary coating supply lines 9 are β (Ω), a voltage E applied to the CCV unit 7 is obtained by $E=D\times(B\beta/(B+\beta))/((A\alpha/(A+\alpha))+(B\beta/(B+\beta)))$ (KV). That is, the voltage E that is stepped down from the voltage D in accordance with the ratio of the resistance value $(A\alpha/(A+\alpha))$ of a high-voltage region and the resistance value $(B\beta/(B+\beta))$ of a grounded region with respect to the CCV unit 7 is applied to the CCV unit 7.

Therefore, as shown in FIG. 3A, in the coating gun 2 according to the first embodiment of the invention, high voltage having the voltage E lower than the voltage D applied to the air motor 4 is applied to the CCV unit 7, and the potential difference with respect to the coupling portion 3*c* that is the grounded region is the potential difference E smaller than the potential difference D. That is, in the coating gun 2, a voltage that is intermediate between the voltage in the high-voltage region and the voltage in the grounded region is applied to the CCV unit 7, and the potential difference between the CCV unit 7 and the grounded region may be reduced as compared with the existing coating gun. As the potential difference between the high-voltage region and the grounded region reduces, a dielectric breakdown is hard to occur even when the insulation distance L2 is reduced as compared with the existing art, so the CCV unit 7 may be arranged further close to the grounded region.

Therefore, the CCV unit 7 and the coupling portion 3*c* just need to ensure the insulation distance L2 based on the potential difference E, and the structure of the first casing portion 3*a* that surrounds the CCV unit 7 also just needs to have a structure based on the potential difference E, so a joint may be easily provided near the CCV unit 7 in the first casing portion 3*a*, and the CCV unit 7 and the coupling portion 3*c* may be arranged further close to each other as compared with the existing art.

Furthermore, electrostatic energy F that is emitted when a dielectric breakdown occurs is obtained by the mathematical expression $F=\frac{1}{2}CV^2$ (C is the capacitance of the CCV unit 7). Therefore, if the potential difference between the CCV unit 7 and the coupling portion 3*c* is reduced to about a half as compared with the existing art, the electrostatic energy F that is emitted when a dielectric breakdown occurs may be reduced to about a quarter. That is, when the coating gun 2 is used, it is possible to improve electrostatic safety.

That is, the coating gun 2 according to the first embodiment of the invention includes: the high-voltage generating device 6 that is used to generate high voltage; the air motor 4 that is a motor portion to which the high voltage is applied; the bell cup 5 that is supported on the rotary shaft 4*a* of the air motor 4 and to which the high voltage is applied; the CCV unit 7 that is a color change valve unit and that selectively supplies a plurality of types of coatings to the bell cup 5; the gun body 3 that is a casing and that contains the high-voltage generating device 6, the air motor 4 and the CCV unit 7; and the coupling portion 3*c* that is used to couple the gun body 3 to the robot arm 8 and that is grounded. The air motor 4 and the CCV unit 7 are electrically connected to each other via the first resistor 11, and the coupling portion 3*c* and the CCV unit 7 are electrically connected to each other via the second resistor 12. With the above configuration, the insulation distance that should be ensured around the CCV unit 7 may be reduced. By so doing, the coating gun 2 that contains the CCV unit 7 may be further compact.

Note that, in the present embodiment, the first resistor 11 and the second resistor 12 are connected to the CCV unit 7 contained in the first casing portion 3*a*; however, a component for which the insulation distance is reduced is not necessarily the CCV unit. Even when another type of component is contained in the first casing portion 3*a* or the second casing portion 3*b*, the resistors 11 and 12 are similarly connected to that component to make it possible to reduce the insulation distance of that component.

Next, the advantageous effects of the coating gun 22 according to a second embodiment of the invention will be described with reference to FIG. 4 to FIG. 5B. Note that, as shown in FIG. 4, the coating gun that is an electrostatic coating gun according to the second embodiment of the invention differs from the coating gun 2 in that variable resistors are used as resistors 31 and 32, and the other configuration is the same as that of the coating gun 2.

As described above, a voltage E applied to the CCV unit 7 is obtained by $E=D\times(B\beta/(B+\beta))/((A\alpha/(A+\alpha))+(B\beta/(B+\beta)))$ (KV). However, the resistance values $\alpha$ and $\beta$ are variable in accordance with the types of coatings used, the number of the primary coating supply lines 9 used, and the like, so the ratio of the resistance value $(A\alpha/(A+\alpha))$ of a high-voltage region and the resistance value $(B\beta/(B+\beta))$ of a grounded region with respect to the CCV unit 7 varies in accordance with coating conditions.

Figure 5A:
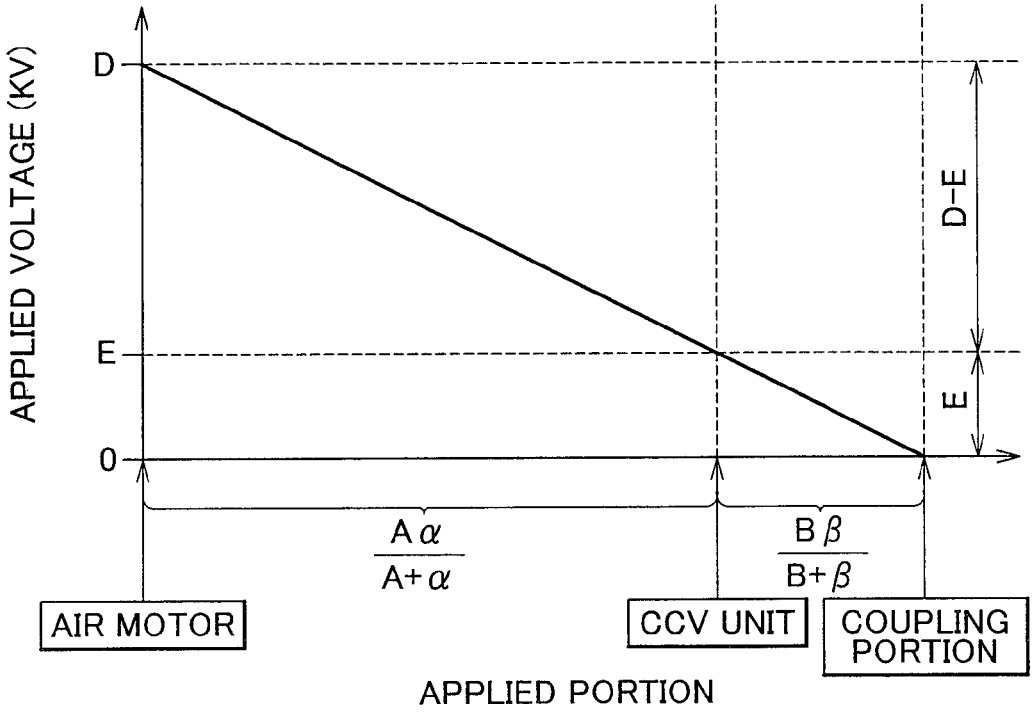
FIG. 5A is a schematic graph that shows a voltage applied to the CCV unit in the case of the coating gun according to the first embodiment of the invention.

Therefore, in the coating gun 2 according to the first embodiment of the invention, when the types of coatings used, the number of the primary coating supply lines 9 used, and the like, are significantly changed in accordance with coating conditions, the high voltage E applied to the CCV unit 7 varies by a large amount, and it is difficult to ensure the insulation distance. In addition, in such a case, as shown in FIG. 5A, the potential difference (D−E) between the CCV unit 7 and the air motor 4 is excessive, and there is a possibility that a dielectric breakdown occurs between the CCV unit 7 and the air motor 4.

Figure 4:
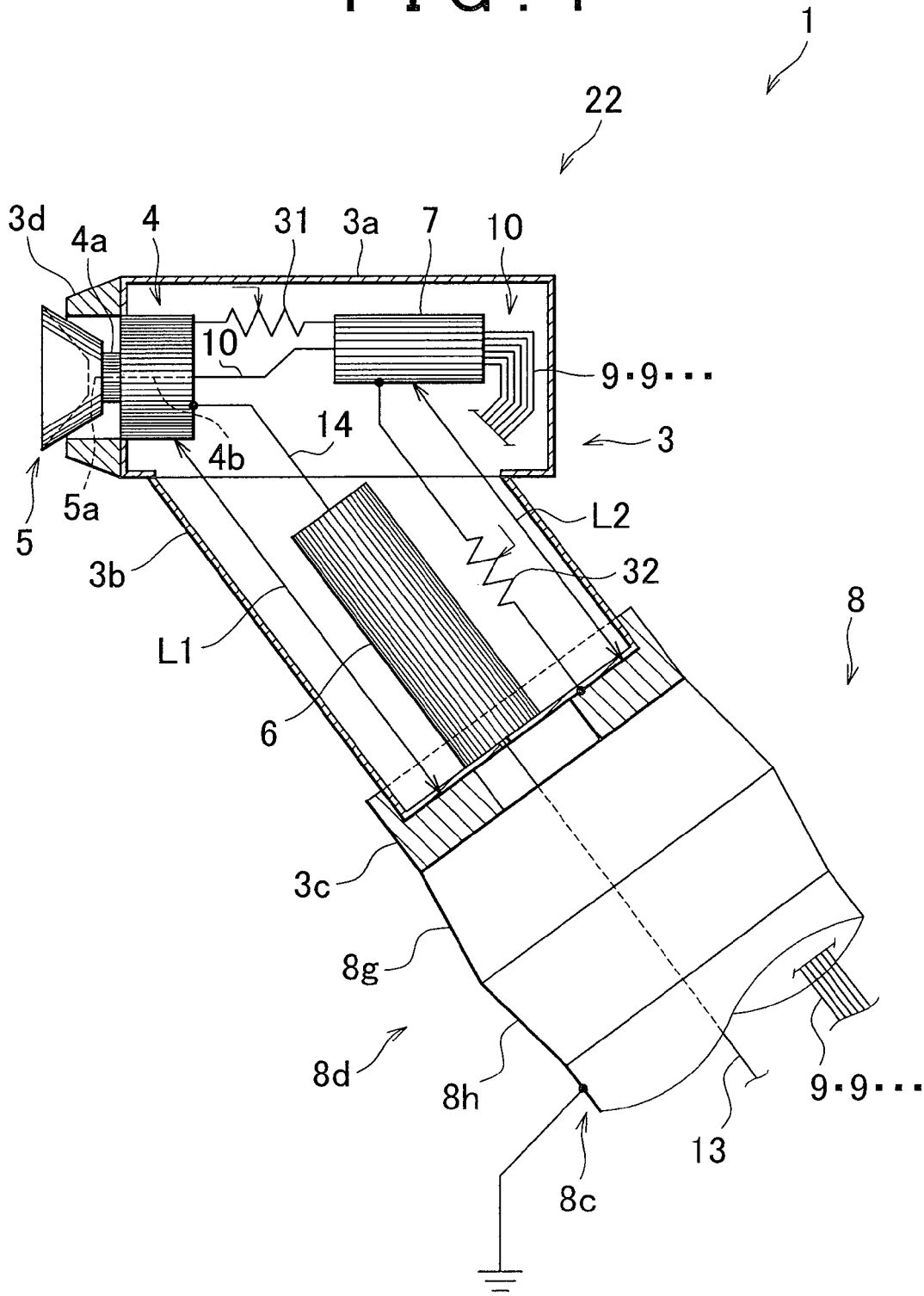
FIG. 4 is a schematic cross-sectional view of a coating gun according to a second embodiment of the invention.
Figure 5B:
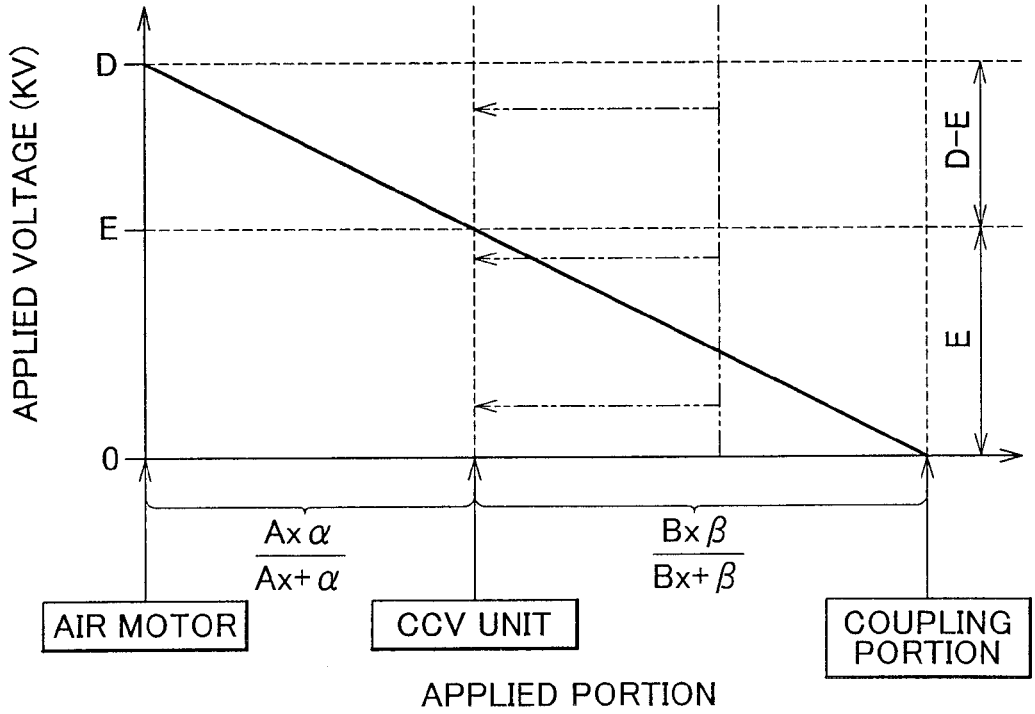
FIG. 5B is a schematic graph that shows a voltage applied to a CCV unit in the case of the coating gun according to the second embodiment of the invention.

Then, in order to solve such a problem, in the coating gun 22 according to the second embodiment of the invention shown in FIG. 4, variable resistors are respectively employed as the first resistor 31 and the second resistor 32. The respective resistance values Ax and Bx of the first resistor 31 and the second resistor 32 may be varied to selected values within a predetermined range. Therefore, when the coating gun 22 is used, a voltage E applied to the CCV unit 7 is obtained by $E=D\times(Bx\beta/(Bx+\beta))/((Ax\alpha/(Ax+\alpha))+(Bx\beta/(Bx+\beta)))$ (KV).

With the above configuration, the resistance values Ax and Bx of the resistors 31 and 32 are adjusted on the basis of the usage conditions of the CCV unit 7 (that is, the types of coatings that flow through the primary coating supply lines 9 and the secondary coating supply line 10, the numbers of the lines 9 and 10 used, and the like) to thereby make it possible to adjust the ratio of the resistance value $(Ax\alpha/(Ax+\alpha))$ of the high-voltage region and the resistance value $(Bx\beta/(Bx+\beta))$ of the grounded region with respect to the CCV unit 7, so the voltage applied to the CCV unit 7 may be adjusted to a value appropriate to the condition of the insulation distance that can be ensured by the gun body 3. In addition, the potential difference (D−E) between the CCV unit 7 and the air motor 4 may also be reliably adjusted to a value at which a dielectric breakdown does not occur.

That is, in the coating gun 22 according to the second embodiment of the invention, the first resistor 31 provided between the air motor 4 and the CCV unit 7 and the second resistor 32 provided between the CCV unit 7 and the coupling portion 3*c* each are formed of a variable resistor of which the resistance value is variable. With the above configuration, even when the types of coatings used and the number of the types are changed, a voltage applied to the CCV unit 7 may be adjusted to a constant value. By so doing, a voltage applied to the CCV unit 7 may be reliably adjusted to an applied voltage appropriate to the insulation distance that may be ensured around the CCV unit 7 in the gun body 3.

Note that, in the present embodiment, both the first resistor 31 and the second resistor 32 each are formed of a variable resistor, and, more specifically, a voltage applied to the CCV unit 7 is adjustable; instead, for example, it is also applicable that any one of the first resistor 31 and the second resistor 32 is formed of a variable resistor and a voltage applied to the CCV unit 7 is adjustable with a simpler configuration.

The invention claimed is:

1. An electrostatic coating gun comprising:

a high-voltage generating device that is used to generate high voltage;

a motor portion to which the high voltage is applied;

a bell cup that is supported on a rotary shaft of the motor portion and to which the high voltage is applied;

a color change valve unit that selectively supplies a plurality of types of coatings to the bell cup;

a casing that contains the high-voltage generating device, the motor portion and the color change valve unit; and a coupling portion that is used to couple the casing to a robot arm and that is grounded, wherein the motor portion and the color change valve unit are electrically connected to each other via a first resistor, and the coupling portion and the color change valve unit are electrically connected to each other via a second resistor.

2. The electrostatic coating gun according to claim 1, wherein at least one of the first resistor and the second resistor is formed of a variable resistor of which a resistance value is variable.

3. The electrostatic coating gun according to claim 1, wherein the first resistor and the second resistor are each formed of a variable resistor of which a resistance value is variable.

* * * * *